US006702643B1

(12) United States Patent
Drosendahl et al.

(10) Patent No.: US 6,702,643 B1
(45) Date of Patent: Mar. 9, 2004

(54) COLLAPSIBLE INFANT ENTERTAINMENT ASSEMBLY

(75) Inventors: Christine Drosendahl, East Aurora, NY (US); Jerry May, Colden, NY (US); Timothy J. Snyder, West Seneca, NY (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 10/351,619

(22) Filed: Jan. 27, 2003

(51) Int. Cl.[7] ..... A63H 5/00
(52) U.S. Cl. ..... 446/227; 446/175
(58) Field of Search ..... 446/227, 214, 446/175, 71, 29, 7

(56) References Cited

U.S. PATENT DOCUMENTS

| | | | |
|---|---|---|---|
| 3,564,759 | A | 2/1971 | Buttermore |
| 3,638,602 | A | 2/1972 | Carreno |
| 3,699,704 | A | 10/1972 | Hakim |
| 3,731,420 | A | 5/1973 | Crosman |
| 3,832,799 | A | 9/1974 | Vennola |
| 4,147,344 | A | 4/1979 | Lee |
| 4,188,745 | A | 2/1980 | Harvey et al. |
| 4,207,696 | A | 6/1980 | Hyman et al. |
| 4,335,538 | A | 6/1982 | Greenberg |
| 4,363,181 | A | 12/1982 | Hyman et al. |
| 4,479,329 | A | 10/1984 | Fraden |
| 4,561,549 | A | 12/1985 | Yokohori |
| 4,640,034 | A | 2/1987 | Zisholtz |
| D288,829 | S | 3/1987 | Cheuk-Sun |
| 4,664,640 | A | 5/1987 | Shindo et al. |
| 4,702,719 | A | 10/1987 | Lapid |
| 4,973,286 | A | 11/1990 | Davison |
| 4,984,380 | A | 1/1991 | Anderson |
| 5,059,463 | A | 10/1991 | Peters |
| 5,076,520 | A | 12/1991 | Bro |
| D339,173 | S | 9/1993 | Marschak |
| 5,250,002 | A | 10/1993 | Kinberg |
| 5,370,570 | A | 12/1994 | Harris |
| 5,387,146 | A | 2/1995 | Smith et al. |
| D359,869 | S | 7/1995 | Oren |
| 5,478,268 | A | 12/1995 | Au |
| D374,691 | S | 10/1996 | Chow et al. |
| D387,814 | S | 12/1997 | Chow et al. |
| 5,788,253 | A | 8/1998 | Thomson et al. |
| 5,803,786 | A | 9/1998 | McCormick |
| D408,192 | S | 4/1999 | Chiang |
| 5,928,054 | A | 7/1999 | Mast |
| 5,951,360 | A | 9/1999 | Fearon et al. |
| 6,066,022 | A | 5/2000 | Fobean et al. |
| 6,068,285 | A | 5/2000 | Jackson et al. |
| 6,113,455 | A | 9/2000 | Whelan et al. |
| 6,142,849 | A | 11/2000 | Horton et al. |
| 6,199,229 | B1 | 3/2001 | Wong |
| 6,203,395 | B1 | 3/2001 | McElhaney |
| D450,516 | S | 11/2001 | Darling et al. |
| D451,970 | S | 12/2001 | Chan |
| 6,332,824 | B2 | 12/2001 | Tell et al. |

FOREIGN PATENT DOCUMENTS

| | | | |
|---|---|---|---|
| JP | 7-47176 | A | 2/1995 |
| JP | 7-148354 | A | 6/1995 |
| JP | 9-84964 | A | 3/1997 |
| JP | 9-299620 | A | 11/1997 |

*Primary Examiner*—Kien T. Nguyen
(74) *Attorney, Agent, or Firm*—Cooley Godward LLP

(57) ABSTRACT

The present invention provides an infant entertainment device and a support assembly for positioning the entertainment device in view of an infant. The support is reconfigurable between an expanded configuration and a collapsed configuration. The entertainment device is responsive to actuation of a motion detector coupled to the entertainment device.

25 Claims, 8 Drawing Sheets

COLLAPSIBLE INFANT ENTERTAINMENT ASSEMBLY

BACKGROUND

1. Field of the Invention

The present invention relates generally to infant entertainment devices and more particularly to selectively actuated entertainment devices coupled to a reconfigurable support.

2. Discussion of the Related Art

Infant entertainment devices coupled to supports, such as mats, are known in the art. Conventional infant entertainment devices that are coupled to mats do not provide a high level of entertainment for the infant user. Traditionally, such entertainment devices are limited by the stability of the support (i.e., the ability of the support to carry significant weight) and the desire to make the mat/entertainment device assembly relatively portable.

There are mats that have entertainment features suspended above them from flexible supports such that the mat can be folded for easy storage and transportation, but the entertainment features are typically static figures that can only be moved when the infant contacts the figures. Infants who cannot reach the figures, or infants who do not have the motor skills to strike the figure, receive little entertainment value from the figures.

There are also entertainment devices that are configured to be positioned above infants that are lying on a support surface. Such entertainment devices do not include a mat, or other support, upon which an infant can lie. Moreover, such devices typically are not portable, and include cumbersome support assemblies to properly position the entertainment features above the infant.

Thus, there is a need for a collapsible infant support including an entertainment device and that is easily reconfigured from a stored position to a use position and that can be easily transported.

SUMMARY OF THE INVENTION

The present invention provides an apparatus including a mat having a first portion and a second portion, a support coupled to and extending above the mat, and an entertainment device coupled to the support. The entertainment device includes a motion detector. The mat is reconfigurable between an expanded configuration and a collapsed configuration, such that in the expanded configuration, the first portion and the second portion define a planar surface spaced apart from the entertainment device and in the collapsed configuration, the first portion and the second portion do not define the planar surface. An output generator is operatively coupled to the entertainment device. The output generator is responsive to actuation of the motion detector.

According to one aspect of the present invention, a support is coupled to and extends above the mat and the entertainment device is coupled to the support. The entertainment device includes a first actuator configured to move in a first manner, and a second actuator configured to move in a second manner. A first article is suspended from the entertainment device and is operatively coupled to the first actuator such that the first article moves in the first manner. A second article is suspended from the entertainment device and is operatively coupled to the second actuator such that the second article moves in the second manner. More articles may be similarly coupled to the entertainment device.

According to another aspect of the invention, the mat includes a junction portion defined between the first portion and the second portion. A support is coupled to the mat proximate the junction portion. The support includes a first foot member coupled to a first side of the mat, and a second foot member coupled to the second side of the mat. A first support post is coupled to the first foot member, and a second support post is coupled to the second foot member. The first foot member and the second foot member are reconfigurable between a first orientation and a second orientation such that in the first orientation the first foot member and the second foot member are configured to inhibit folding of the mat from an unfolded position, and in the second orientation, the mat is foldable about the junction portion.

These and other aspects of the present invention will become apparent from the following drawings and description.

BRIEF DESCRIPTION OF THE DRAWINGS

The present invention is described with reference to the accompanying drawings. In the drawings, like reference numbers indicate similar elements.

DETAILED DESCRIPTION

Several embodiments of an entertainment assembly 10 incorporating the principles of the invention are shown in FIGS. 1–10. A general description of the device is presented first, followed by a description of one implementation of the invention.

Figure 1:
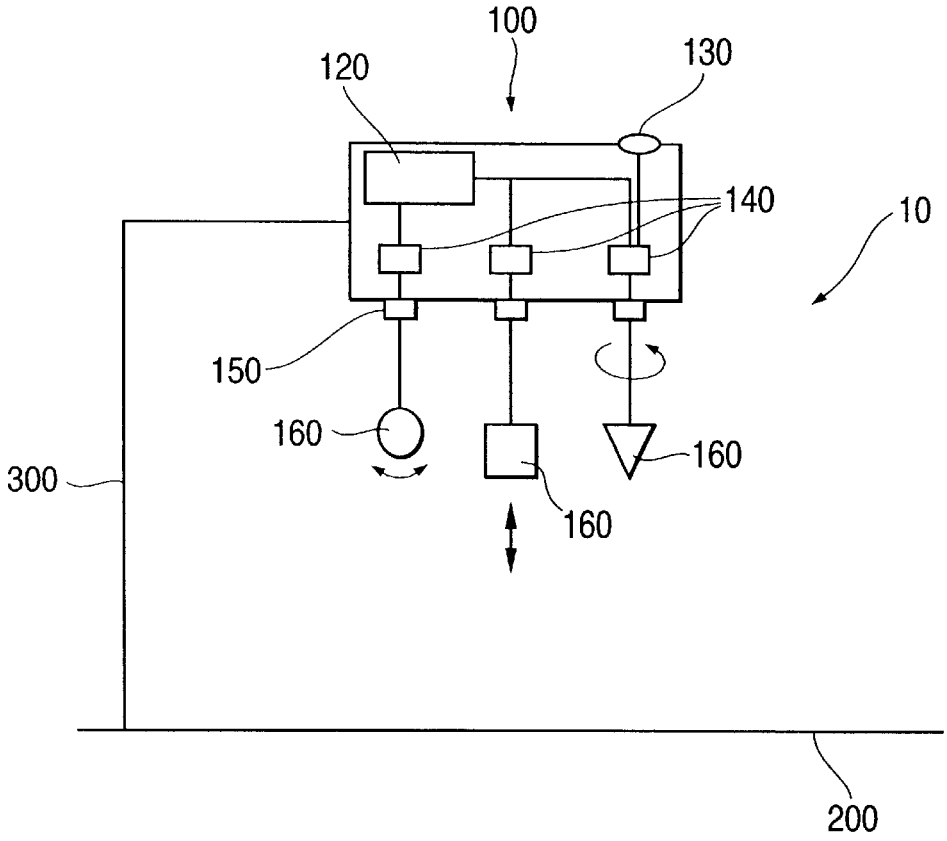
FIG. 1 is a schematic illustration of a generic embodiment of an entertainment assembly incorporating the principles of the invention.

FIG. 1 is a schematic illustration of a generic embodiment of an entertainment assembly 10, which includes an entertainment device 100 that is coupled to a support 300 that in turn is coupled to a mat or base 200. The support 300 is coupled between the mat or base 200 and the entertainment device 100 to support the entertainment device 100 above and opposite the mat 200. The mat is reconfigurable between a first, expanded configuration and a second, collapsed configuration and is configured to provide a support surface for an infant user. In the expanded configuration, the mat 200 defines a planar surface and in the collapsed configuration, the mat does not define a planar surface as will be discussed in greater detail below.

The entertainment device 100 includes a motion detector 120, a manual switch 130 and at least one output generator 140. The output generator can be in the form of an actuator to impart motion to an article 160. Alternatively, or additionally, the output generator 140 can cause a light or a series of lights to be illuminated and can cause audio output from an audio transducer, such as a speaker. The output generator can be selectively actuated via manual switch 130 or can be actuated when motion detector 120 is triggered.

In an embodiment in which there are multiple articles 160 removably suspended from multiple actuators 140, each of the actuators 140 can be configured to cause a different motion (i.e., move the attached article 160 in a different direction) as indicated, for example, by the arrows in FIG. 1.

One implementation of the entertainment assembly 10 discussed above is now described with reference to FIGS. 2–10. The entertainment assembly 10 includes an entertainment device 100, a mat 200 having a first portion 210 and a second portion 220, and a pair of supports 300 coupled to and extending above the mat 200.

The entertainment device 100 includes a housing 105 having a first end 101 and a second end 102. The housing 105 can be dimensioned such that a width or thickness of the housing 105 is substantially the same as the width or thickness of the supports 300 when the assembly 10 is in a collapsed configuration as will be discussed in greater detail below. Within the housing 105 is a motion detector 120 that is operatively coupled to a series of actuators to drive articles 160 that are suspended from the entertainment device 100. The motion detector 120 is also configured to actuate a series of lights 165 and to produce audible output via an audio transducer or speaker positioned adjacent grill 189.

The motion detector 120 is configured to detect motion of an infant user of the entertainment assembly 10 and/or motion or displacement of the entertainment device 100. The motion of the entertainment device may be caused by force imparted directly to the entertainment device 100 or indirectly, for example, via the supports 300 or mat 200. The motion detector can be a ball/conductive ring magnet assembly as in conventional motion detectors. In such assemblies, movement of the motion detector 120 displaces a metal ball from its rest position centered in a conductive ring by a magnet to a position in which it makes contact with the conductive ring, thereby closing or actuating a switch. Other motion detectors that can detect the movement of the entertainment device 100 may also be used. Alternatively, the motion detector 120 can be configured to detect movement of an infant user positioned on the mat 200 beneath the entertainment device 100 regardless of whether the entertainment device 100 is moved. Such a detector may include an infrared detector.

In use, movement of the articles 160 and the actuation of lights and sounds can be initiated by the motion detector 120 as described or can be initiated by a manual switch 130. Each of the articles 160 can be in any form that is entertaining to a child. In the illustrated embodiment, the articles are shown as different shapes. The articles can also include animals, human figures and the like. The articles are configured to each move in a separate manner such that rotation about, and/or translation along, one or more axes. For example, one of the articles 160 can move side-to-side. A second of the articles 160 can move up and down. A third of the articles can spin around an axis perpendicular to the housing 105.

Figure 2:
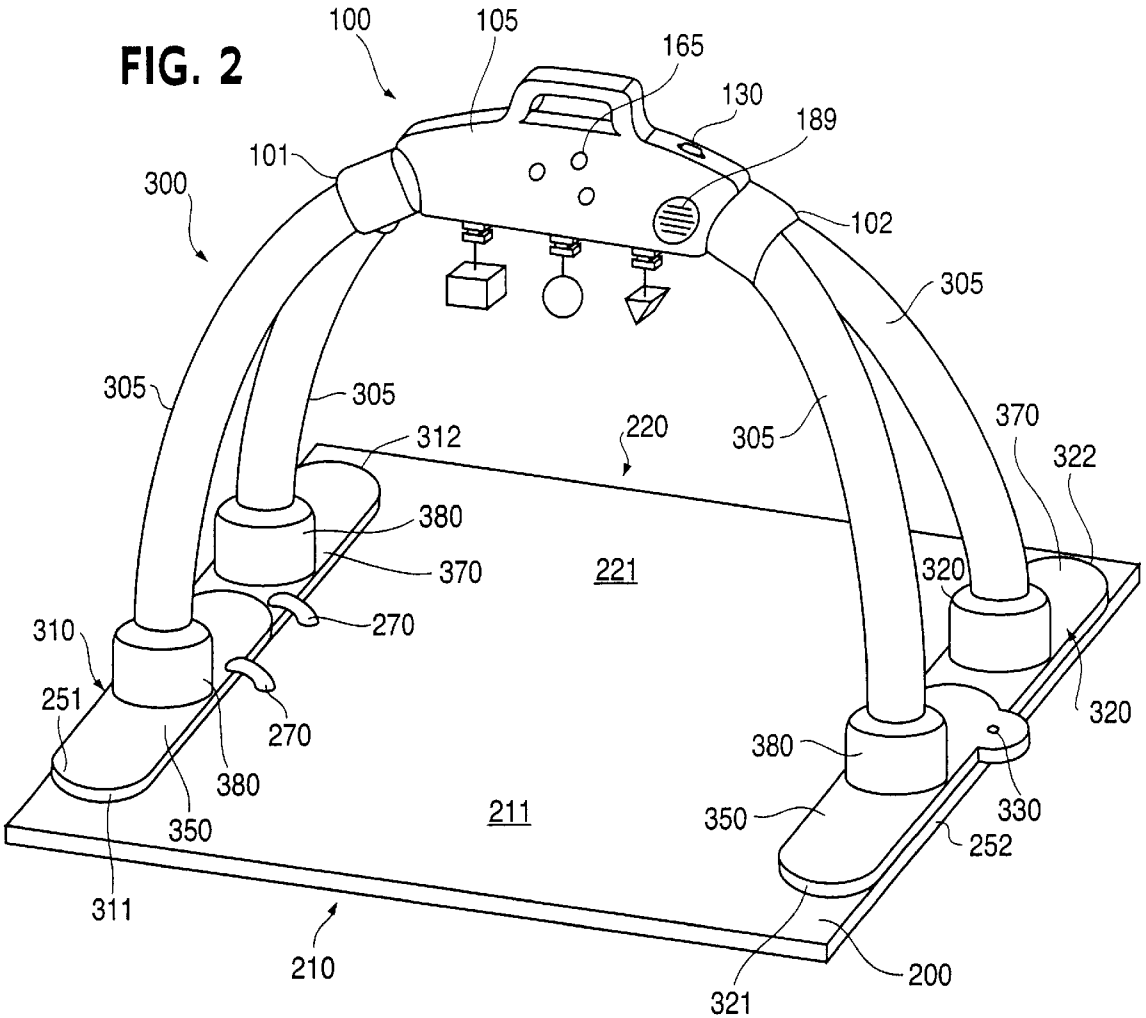
FIG. 2 is a perspective view of one embodiment of an entertainment assembly embodying the principles of the present invention.
Figure 3:
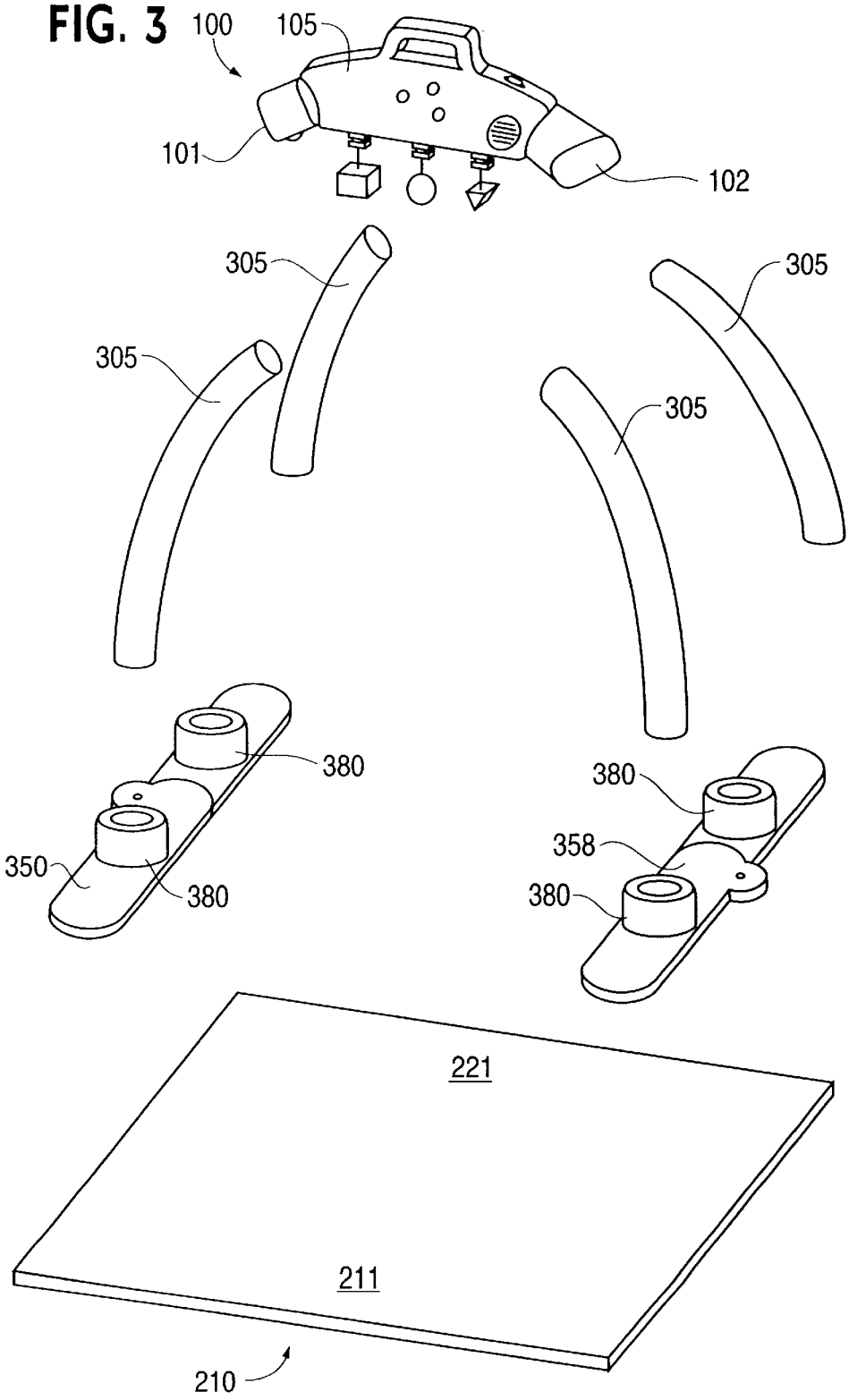
FIG. 3 is an exploded perspective view of the entertainment assembly illustrated in FIG. 2.
Figure 4:
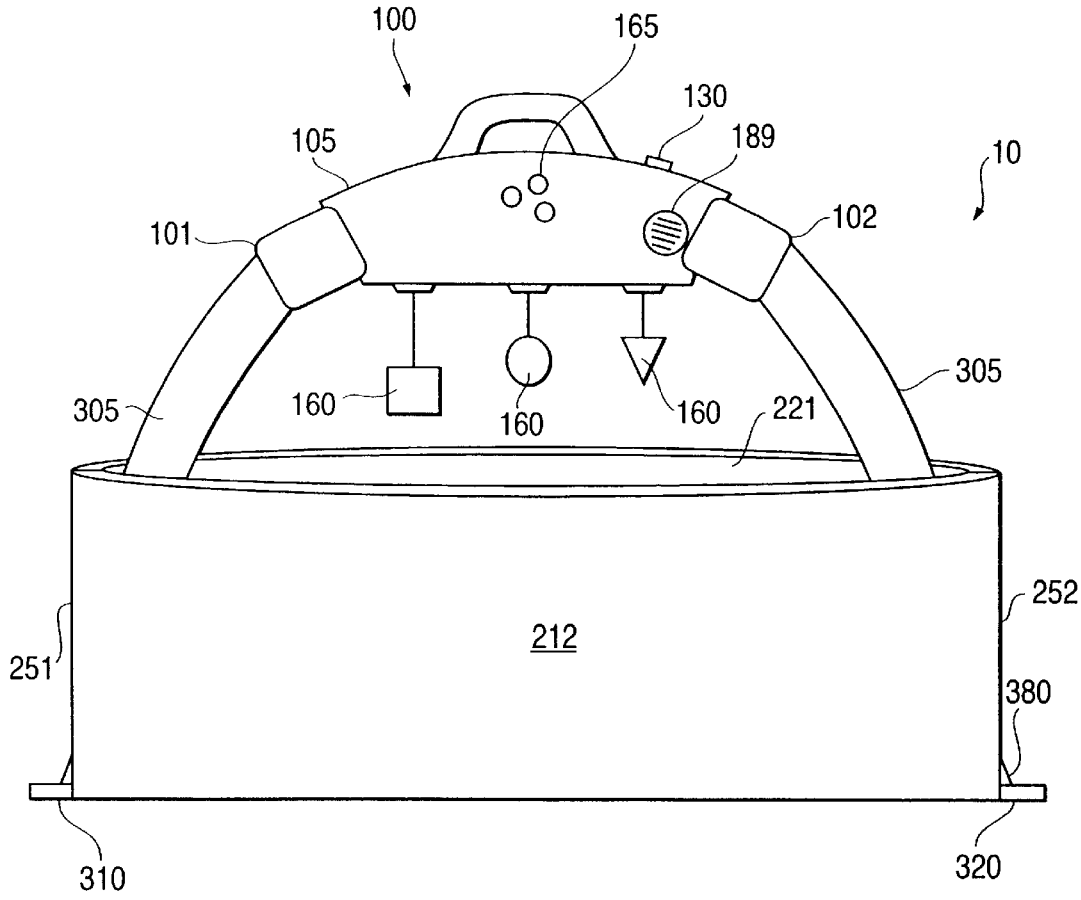
FIG. 4 is a side view of an embodiment of an entertainment assembly embodying the principles of the invention, shown in a collapsed configuration.
Figure 5:
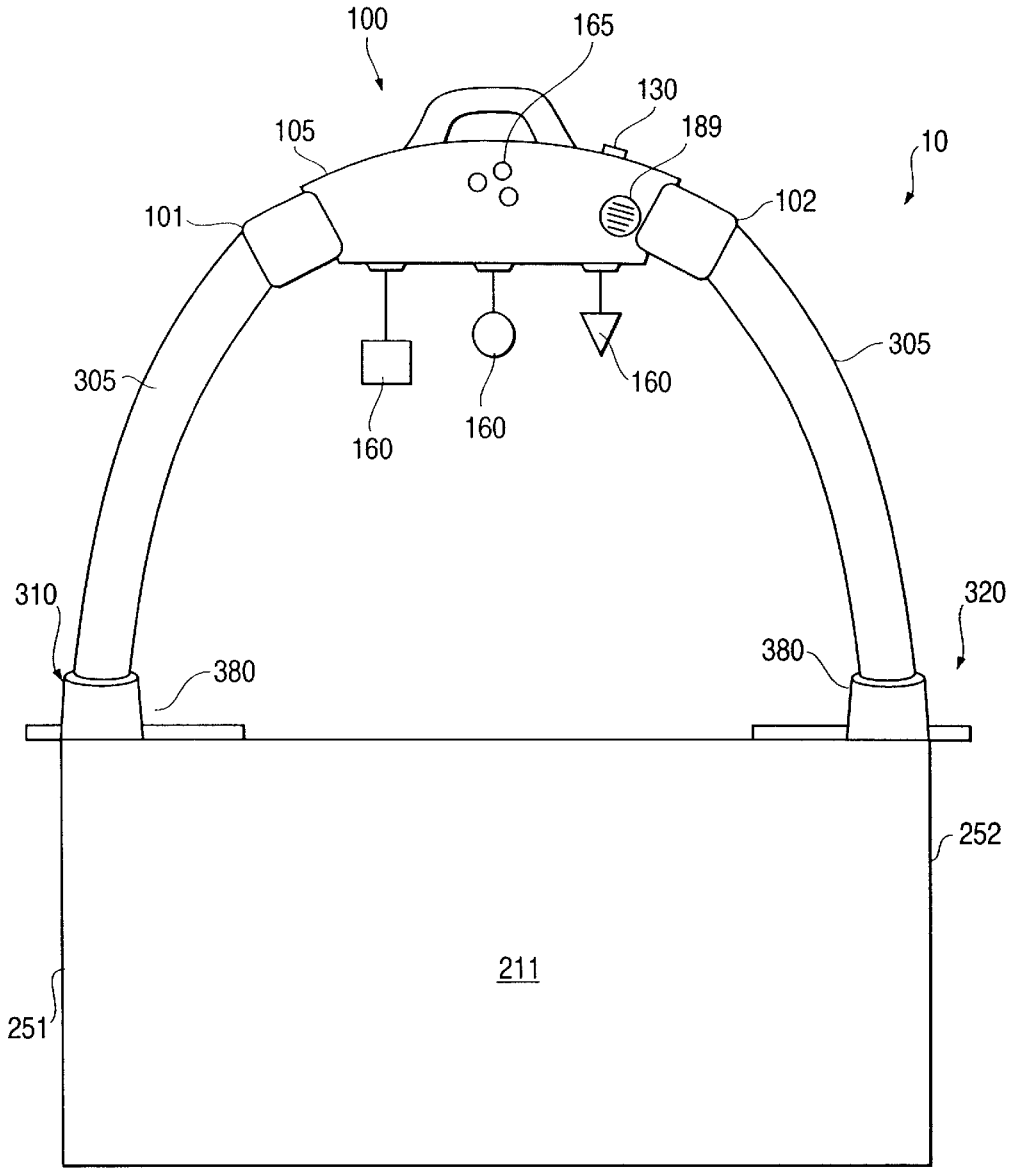
FIG. 5 is a side view of the entertainment assembly of FIG. 4 shown in an alternative collapsed configuration.
Figure 6:
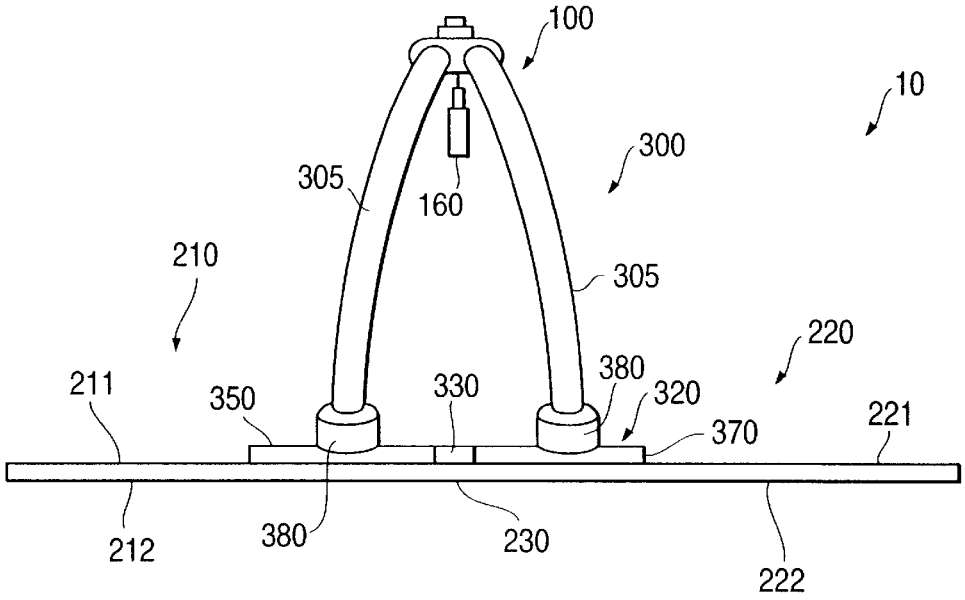
FIG. 6 is an alternative side view of an embodiment of an entertainment assembly embodying the principles of the invention, shown in an expanded configuration.
Figure 7:
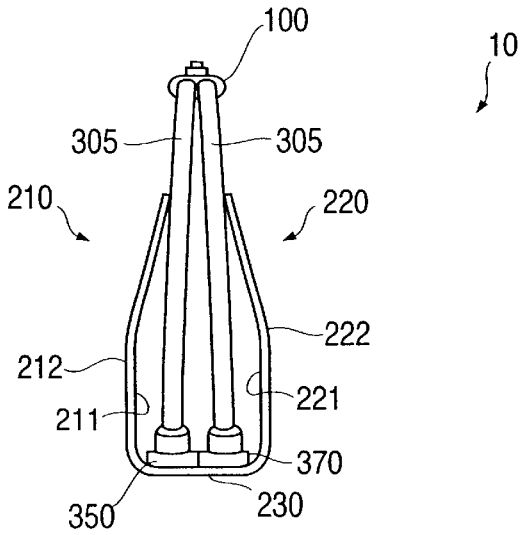
FIG. 7 is an alternative side view of an embodiment of the entertainment assembly of FIG. 6 shown in a collapsed configuration.

The mat 200 is positioned beneath the entertainment device 100 and is reconfigurable between an open, expanded configuration (as illustrated in FIGS. 2 and 6), and a closed, collapsed configuration (as illustrated in FIGS. 4, 5 and 7). The first portion 210 of the mat has a first or upper face 211 and a second or lower face 212. Likewise, the second portion 220 of the mat has a first or upper face 221 and a second or lower face 222. The first faces 211, 221 are positioned opposite the entertainment device 100 and are configured to receive an infant user thereon when the mat 200 is in the expanded configuration. The second faces 212, 222 are configured to engage a support surface when the mat 200 is in the expanded configuration. There is a junction portion 230 that is defined between the first portion 210 and the second portion 220 adjacent the lower end of the support 300. The first portion 210, the second portion 220 and the junction portion 230 may be integrally formed or may be separate elements that are permanently or removably coupled. In the illustrated embodiment, the mat 200 is formed of quilted fabric.

In the illustrated embodiment, the support 300 includes four support posts 305 coupled between the mat 200 and the entertainment device 100. The posts 305 are coupled to the mat 200 via a first foot member 310 coupled to a first side 251 of the mat 200 and a second foot member 320 coupled to a second side 252 of the mat 200 as in the illustrated embodiment. Each post 305 is a cylinder of foam covered with fabric. The posts 305 are dimensioned to support the entertainment device 100 above the mat 200 at such a distance to allow an infant to be positioned underneath the device 100 when the assembly 10 is in use.

In the illustrated embodiment, the support posts 305 are removably coupleable to one of the foot members 310, 320.

Each of the foot members 310, 320 is reconfigurable between a first orientation and a second orientation. In the first orientation, the first foot member 310 and the second foot member 320 are configured to inhibit folding of the mat 200 from an unfolded position. The mat 200 is inhibited from folding by virtue of the position of the foot members 310, 320 along the edge of the mat 200 as illustrated in FIG. 2. The foot members 310, 320 can be moved out of position to a second orientation, off the edge of the mat 200, to allow the mat 200 to be folded as illustrated in FIG. 4. In the second orientation, the mat 200 is foldable about the junction portion 230 as will be described below. The mat 200 can be removably coupled to the foot members 310, 320 by straps 270, which can be attached to the mat 200 and the foot members 310, 320 via known attachment devices such as snaps, buttons, adhesive, and hook-and-loop type fasteners. This permits the mat 200 to be removed from the entertainment assembly 10 for cleaning.

Figure 8:
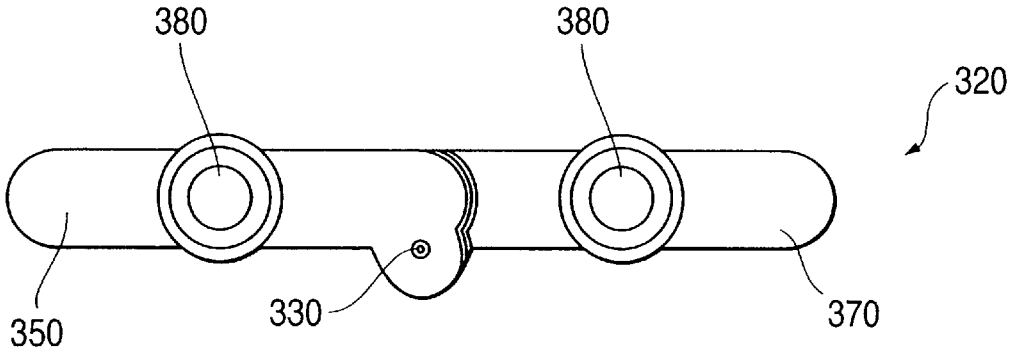
FIG. 8 is a top plan view of a portion of a support embodying the principles of the present invention in a first configuration.
Figure 9:
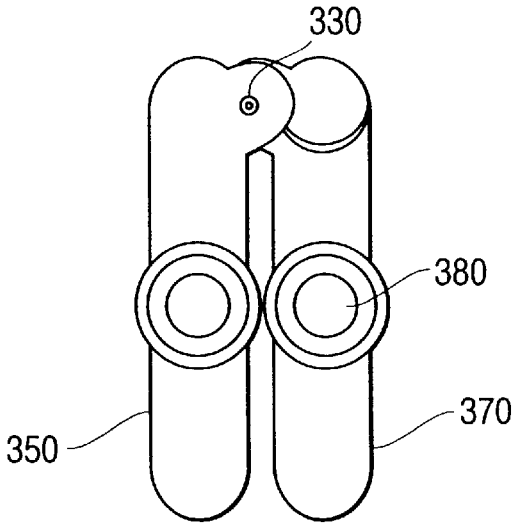
FIG. 9 is a top plan view of the portion of the support of FIG. 8 in a second configuration.

Each foot member 310, 320 has a first end 311, 321 respectively, and a second end 312, 322 respectively. In the illustrated embodiment, and as best seen in FIGS. 2, 8 and 9, the foot members 310, 320 each include a first leg 350 and a second leg 370. Legs 350 and 370 are pivotally coupled together at pivot 330 (such as by a rivet or pin, or by an integrally formed post and socket). This permits the legs 350 and 370 to be moved between the first, deployed configuration shown in FIG. 8, and the second, stowed or collapsed configuration shown in FIG. 9.

Each leg 350, 370 includes a collar 380 that is configured to receive a lower end of a support post 305. The support post 305 is removably coupled to the collar 380 by a friction fit between the outside of the end of the post and the inside of a collar 380. Preferably, the force required to displace the post 305 from the collar 380 is high enough that the weight of mat 200 can be carried by post 305, but not high enough to carry an infant user on the mat. Other suitable removable connections between the posts 305 and the foot members 310, 320 ca include hook-and-loop fasteners, buttons, adhesives, and the like.

In the illustrated embodiment, the support 300 is also reconfigurable between an open, expanded configuration (as illustrated in FIGS. 2 and 6), and a closed, collapsed configuration (as illustrated in FIGS. 4, 5 and 7). The support 300 can be reconfigured by moving the foot members 310, 320 between the first configuration or orientation and the second configuration or orientation. In the expanded orientation, illustrated in FIG. 8, the first leg 350 and the second leg 370 are substantially collinear such that the foot members 310, 320 inhibit folding of the mat 200. In the collapsed orientation, illustrated in FIG. 9, the first leg 350 and second leg 370 are parallel and not collinear. By virtue of their connection to the foot members 310, 320, when the legs 350, 370 are reconfigured, the support posts 305 will likewise be reconfigured. When the support posts 305 are in the expanded configuration they are spaced apart as illustrated in FIGS. 2 and 6 to maintain a stable configuration of the entertainment assembly 10. In the collapsed configuration, the support posts 305 are positioned adjacent one another to allow the mat 200 to be easily folded as illustrated in FIGS. 4, 5 and 7.

In use, a user can move the entertainment assembly 10 between the expanded configuration and the collapsed configuration. From the expanded configuration, the assembly 10 can be moved to the collapsed configuration by first reorienting the foot members 310, 320 of the support 300 as described above, thereby allowing the mat 200 to be folded. When the foot members are reoriented, the support posts 305 are positioned adjacent one another. When the support 300 is in the collapsed configuration, the mat 200 can then be folded. In the illustrated embodiment, as best seen in FIGS. 4 and 7, the first portion 210 and the second portion 220 are folded such that the first face 211 of the first portion 210 and the first face 221 of the second portion are opposite one another. In the collapsed configuration, the first portion 210 and second portion 220 can be coupled together by mating fasteners attached to the respective portions. In the alternative embodiment illustrated in FIG. 5, the mat 200 is folded such that the second face 212 of the first portion 210 is positioned opposite the second face 222 of the second portion 220. In either of the illustrated collapsed configurations, the assembly is more compact and easily transported than in the expanded configuration.

Figure 10:
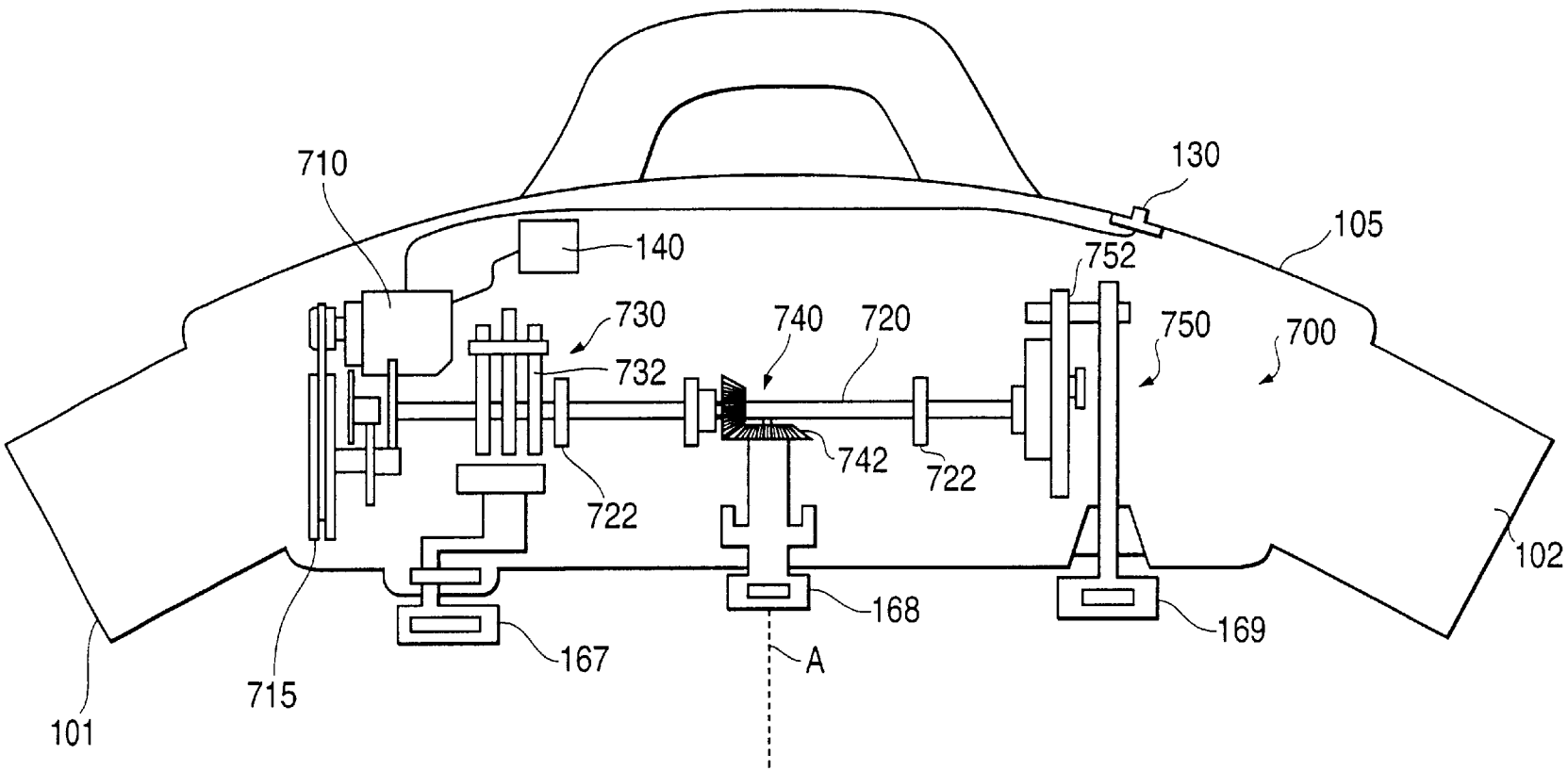
FIG. 10 is a cut away view of the housing of the entertainment device embodying the principles of the present invention.

The articles can be moved by a drive assembly 700 illustrated in FIG. 10. The drive assembly 700 includes a motor 710, a drive shaft 720 supported by shaft supports 722, a first drive 730 coupled to the drive shaft 720, a second drive 740 coupled to the drive shaft, and a third drive 750 coupled to the drive shaft 720. A series of drive gears or pulleys 715 are configured to couple the motor 710 to the drive shaft 720. Thus, the rotational output of the motor 710 is imparted to the drive shaft 720 to drive the articles 160 (not illustrated in FIG. 10).

The drive shaft can be operatively coupled to each of the articles 160 in such a manner that a different motion is imparted to different articles. For example, the first drive 730 is coupled to the drive shaft 720 in via linkages 732 to cause the first article holder 167 to move side to side, or in a reciprocal, translational movement along a vertical axis or in a reciprocal, translational movement along a horizontal axis. An article 160 suspended from the first article holder 167 would thus swing from side to side. The second drive 740 can be coupled to the drive shaft 720 via a series of bevel gears 742 to cause the article to rotate about a vertical axis A. An article coupled to article holder 168 would thus rotate with respect to axis A as illustrated in FIG. 10. The third drive 750 is coupled to the drive shaft 720 through a series of gears 752 to cause an article coupled to the third article holder 169 to move up and down.

The articles 160 can be moved in a variety of directions depending upon the manner in which the article holder is coupled to the drive shaft 720. While three examples of possible connections are illustrated, any connection that causes the article to move when switch 130 and/or motion detector 140 are actuated is contemplated by the present invention.

While particular, illustrative embodiments of the invention have been described, numerous variations and modifications exist that would not depart from the scope of the invention. For example, as described above, the articles 160 are described as being removably coupled to the entertainment device 100. Alternatively, the articles 160 can be fixedly coupled. In a further alternative embodiment, some of the articles 160 can be removably coupled and some fixedly coupled.

As described above, each of the articles 160 suspended from the entertainment device 100 is moved in some fashion. Alternatively, one or more articles 160 can be rigidly coupled to the entertainment device 100 such that they cannot be moved by the user.

Also as described above, the housing 105 can be dimensioned such that a width of the housing 105 is substantially the same as the width of the supports 300 when the assembly 10 is in the collapsed configuration. Alternatively, the housing can be any shape or width provided it is easily stored and transported.

As described above, the support 300 can include multiple support posts 305. Alternatively, the support 300 can include a single support post 305 on each side of the entertainment device 100. In a further alternative configuration, the assembly 10 can include a single support post 305 on only one side of the entertainment device, provided the post 305 is able to support the entertainment device 100 above the mat 200 as described. In such a configuration, it may not be necessary to collapse the support 300 to allow the mat 200 to be folded, depending upon the configuration of the foot member included to support to the single post 305.

As described above, the posts 305 are fabric covered foam cylinders. The posts can be flexible or rigid provided they are able to support the entertainment device 100. In an alternative embodiment, the posts 305 may also have a telescoping configuration to move between the expanded and collapsed configuration.

In one embodiment, the foot members 310, 320 can be pivotally coupled to the mat 200 at either end such that the foot member 310, 320 can be repositioned to allow the mat 200 to be folded. Alternatively, the foot members 310, 320 may be pivotally coupled to the mat 200 about a pivot 330.

As described above, when the entertainment assembly 10 is to be moved from the expanded configuration to the collapsed configuration, the foot members 310, 320 are pivoted about pivot 330 to allow the mat 200 to be folded.

Alternatively, the foot members 310, 320 can be pivoted about one of their ends 311, 312, 321, 322 to allow the mat 200 to be folded. In a further alternative configuration, the foot members 310, 320 can be completely removed from the mat 200 to allow the mat 200 to be folded.

In yet another alternative embodiment, the supports 300 can be fixed. In such an embodiment, the mat 200 can be collapsed by rolling the portions 210, 220 of the mat 200 or folding them up around the expanded support posts 305. Moreover, the mat 200 can be rolled in any configuration of the supports 300 instead of maintaining its shape as described above. The mat 200 is described above as being made of flexible quilted fabric. Alternatively, the mat 200 could be rigid or resilient.

Conclusion

While various embodiments of the present invention have been described above, it should be understood that they have been presented by way of example only, and not limitation. Thus, the breadth and scope of the present invention should not be limited by any of the above-described exemplary embodiments, but should be defined only in accordance with the following claims and their equivalents.

The previous description of the preferred embodiments is provided to enable any person skilled in the art to make or use the present invention. While the invention has been particularly shown and described with reference to preferred embodiments thereof, it will be understood by those skilled in the art that various changes in form and details may be made therein without departing from the spirit and scope of the invention.

What is claimed is:

1. An apparatus comprising:

a base having a first portion and a second portion;

a support having a first end coupled to said base and a second end spaced from said base;

an entertainment device coupled to said support, said entertainment device including a motion detector, said base being reconfigurable between an expanded configuration and a collapsed configuration, such that in the expanded configuration, the first portion and the second portion define a planar surface spaced apart from said entertainment device and in the collapsed configuration, the first portion and the second portion do not define the planar surface; and an output generator operatively coupled to said entertainment device, said output generator responsive to actuation of said motion detector.

2. The apparatus of claim 1, each of said first portion and said second portion including a first face that is positioned opposite said entertainment device and a second face that is configured to engage a support surface, wherein in the collapsed configuration the first face of the first portion is positioned opposite the first face of the second portion.

3. The apparatus of claim 1, each of said first portion and said second portion including a first face that is positioned opposite said entertainment device and a second face that is configured to engage a support surface, wherein in the collapsed configuration the second face of the first portion is positioned opposite the second face of the second portion.

4. The apparatus of claim 1, said entertainment device further including:

a first article suspended from said entertainment device and configured to move in a first direction; and a second article suspended from said entertainment device and configured to move in a second direction.

5. The apparatus of claim 4, wherein upon actuation of said motion detector said first article moves in the first direction and said second article moves in the second direction.

6. The apparatus of claim 1, wherein said support includes a plurality of posts coupled between said base and said entertainment device.

7. The apparatus of claim 1, wherein said motion detector detects displacement of said entertainment device.

8. The apparatus of claim 1, wherein said motion detector is an infrared detector.

9. The apparatus of claim 9, wherein said support includes a foot member; and a post.

10. The apparatus of claim 9, wherein said support further includes a second foot member; and a second post.

11. An apparatus, comprising:

a base;

a support coupled to and extending above said base; and an entertainment device coupled to said support and including a first actuator configured to move in a first direction;

a second actuator configured to move in a second direction;

a first article suspended from said entertainment device and operatively coupled to said first actuator such that the first article moves in the first direction; and a second article suspended from said entertainment device and operatively coupled to said second actuator such that the second article moves in the second direction the second direction being different from the first direction.

12. The apparatus of claim 11, wherein the first directions is rotation about an axis perpendicular to said entertainment device and the second direction is lateral motion.

13. The apparatus of claim 11, wherein said base includes a first portion and a second portion; said base being reconfigurable between an expanded configuration and a collapsed configuration, such that in the expanded configuration, the first portion and the second portion define a planar surface spaced apart from said entertainment device and in the collapsed configuration, the first portion and the second portion do not define the planar surface.

14. The apparatus of claim 13, each of said first portion and said second portion including a first face and a second face, wherein in the collapsed configuration the first face of the first portion is positioned opposite the first face of the second portion.

15. The apparatus of claim 13, each of said first portion and said second portion including a first face and a second face, wherein in the collapsed configuration the second face of the first portion is positioned opposite the second face of the second portion.

16. An apparatus, comprising:

a base having a first portion, a second portion and a junction portion defined between the first portion and the second portion;

a support coupled to said base proximate the junction portion, said support including a first foot member coupled to a first side of said base;

a second foot member coupled to a second side of said base;

a first support post coupled to said first foot member; and a second support post coupled to said second foot member, said first foot member and said second foot member being reconfigurable between a first orientation and a second orientation such that in the first orientation the first foot member and the second foot member are configured to inhibit folding of said base from an unfolded position, and in the second orientation, said base is foldable about the junction portion; and an entertainment device coupled between the first support post and the second support post.

17. The apparatus of claim 16, wherein each said foot member is pivotally coupled to said base.

18. The apparatus of claim 16, wherein each said foot member has a first end and a second end and each said foot member is pivotally coupled to said base at one of said first end and said second end.

19. The apparatus of claims 16, wherein each said foot member includes a first leg and a second leg, said first leg being pivotally coupled to said second leg such that in the first orientation said first leg and said second leg are collinear and in said second orientation said first leg and said second leg are parallel and not collinear.

20. The apparatus of claim 19, further comprising:

a third support post coupled to said first foot member;

a fourth support post coupled to said second foot member; and a connector coupled to each said leg and configured to receive one of said support posts.

21. The apparatus of claim 16, wherein said entertainment device includes a motion detector; and an output generator operatively coupled to said entertainment device, said output device being responsive to actuation of said motion detector.

22. The apparatus of claim 21, said entertainment device further including:

a first article suspended from said entertainment device and configured to move with a first motion; and a second article suspended from said entertainment device and configured to move with a second motion different from said first motion.

23. The apparatus of claim 22, wherein upon actuation of said motion detector said first article moves in the first direction and said second article moves in the second direction.

24. The apparatus of claim 21, wherein said motion detector detects displacement of said entertainment device.

25. The apparatus of claim 21, wherein said motion detector is an infrared detector.

* * * * *